US008881654B2

(12) United States Patent
Seecamp

(10) Patent No.: US 8,881,654 B2
(45) Date of Patent: Nov. 11, 2014

(54) BULLETS WITH LATERAL DAMAGE STOPPING POWER

(75) Inventor: Lueder Seecamp, Milford, CT (US)

(73) Assignee: LWS Ammunition LLC, Milford, CT (US)

( * ) Notice: Subject to any disclaimer, the term of this patent is extended or adjusted under 35 U.S.C. 154(b) by 0 days.

(21) Appl. No.: 13/273,896

(22) Filed: Oct. 14, 2011

(65) Prior Publication Data

US 2013/0092041 A1 Apr. 18, 2013

(51) Int. Cl.

*F42B 12/34* (2006.01)
*F42B 12/36* (2006.01)
*F42B 30/02* (2006.01)

(52) U.S. Cl.

CPC ..... *F42B 12/36* (2013.01); *F42B 30/02* (2013.01)
USPC ..... 102/508; 102/502; 102/506; 102/514; 102/507

(58) Field of Classification Search

CPC ..... F42B 12/00; F42B 12/367; F42B 12/40; F42B 12/46; F42B 12/54; F42B 12/56; F42B 12/02; F42B 12/34; F42B 12/36; F42B 5/145; F42B 8/14; F42B 8/16; F42B 10/48
USPC ..... 102/370, 372, 430, 439, 441, 444, 455, 102/458, 501, 502, 503, 506, 507, 508, 509, 102/512, 513, 514, 518
See application file for complete search history.

(56) References Cited

U.S. PATENT DOCUMENTS

| | | | | | |
|---|---|---|---|---|---|
| 376,302 | A | * | 1/1888 | Gregg | 102/509 |
| 627,929 | A | * | 6/1899 | Andrews | 102/511 |
| 693,329 | A | * | 2/1902 | Neubauer | 102/512 |
| 843,017 | A | * | 2/1907 | Hoxie | 102/510 |
| 1,073,349 | A | * | 9/1913 | Hoagland | 102/509 |
| 1,135,357 | A | | 4/1915 | Clyne | |
| 1,681,295 | A | * | 8/1928 | Johnson | 102/509 |
| 1,715,788 | A | | 6/1929 | Rosseau | |
| 3,103,889 | A | * | 9/1963 | Keeney, Sr. | 102/506 |
| 3,580,179 | A | | 5/1971 | Gawlick et al. | |
| 3,791,303 | A | | 2/1974 | Sweeney et al. | |

(Continued)

FOREIGN PATENT DOCUMENTS

| | | | |
|---|---|---|---|
| DE | 2820530 | A1 | 11/1979 |
| DE | 4321041 | A1 | 1/1995 |
| EP | 2453200 | A1 | 5/2012 |

OTHER PUBLICATIONS

International Search Report and Written Opinion of the International Searching Authority Application No. PCT/US2012/059852 Completed: Jun. 13, 2013; Mailing Date: Jun. 25, 2013 8 pages.

*Primary Examiner* — Bret Hayes
*Assistant Examiner* — Derrick Morgan
(74) *Attorney, Agent, or Firm* — St. Onge Steward Johnston & Reens LLC

(57) ABSTRACT

Ammunition which includes a bullet having an effective caliber that is larger than its nominal caliber, comprised of a bullet body with a longitudinal cavity in the forward end, and one or more bores extending from the cavity to bore openings on the exterior of the bullet. In use, target media is gathered in the cavity and ejected under force through the bore openings, increasing the damage done by the bullet. Optional embodiments include filled, irritant payload, and jacketed embodiments.

24 Claims, 6 Drawing Sheets

(56) References Cited

U.S. PATENT DOCUMENTS

| | | | | | |
|---|---|---|---|---|---|
| 3,865,038 | A | | 2/1975 | Barr | |
| 3,866,536 | A | * | 2/1975 | Greenberg | 102/510 |
| 3,949,677 | A | | 4/1976 | Voss | |
| 4,091,736 | A | * | 5/1978 | Mizelle | 102/502 |
| 4,136,616 | A | * | 1/1979 | Schirneker | 102/510 |
| 4,245,557 | A | | 1/1981 | Knappworst | |
| 4,348,958 | A | * | 9/1982 | Day | 102/499 |
| 4,610,061 | A | | 9/1986 | Halverson | |
| 4,867,065 | A | | 9/1989 | Kaltmann | |
| 4,947,755 | A | | 8/1990 | Burczynski | |
| 5,133,261 | A | | 7/1992 | Kelsey, Jr. | |
| 5,225,628 | A | | 7/1993 | Heiny | |
| 5,275,110 | A | * | 1/1994 | Flatau | 102/503 |
| 5,528,989 | A | | 6/1996 | Briese | |
| 5,621,186 | A | * | 4/1997 | Carter | 102/507 |
| 5,698,815 | A | | 12/1997 | Ragner | |
| 5,760,329 | A | * | 6/1998 | Baum et al. | 102/439 |
| 5,811,723 | A | | 9/1998 | Stone | |
| 5,945,629 | A | * | 8/1999 | Schildknecht et al. | 102/499 |
| 6,145,441 | A | | 11/2000 | Woodall et al. | |
| 6,176,186 | B1 | | 1/2001 | Engel | |
| 6,178,890 | B1 | * | 1/2001 | Burczynski | 102/507 |
| 6,182,574 | B1 | | 2/2001 | Giannoni | |
| 6,213,022 | B1 | * | 4/2001 | Pullum | 102/439 |
| 6,378,439 | B1 | * | 4/2002 | Saxby | 102/513 |
| 6,453,820 | B1 | | 9/2002 | Anderson | |
| 6,546,874 | B2 | | 4/2003 | Vasel et al. | |
| 6,805,057 | B2 | | 10/2004 | Carr et al. | |
| 6,971,315 | B2 | | 12/2005 | Knappworst et al. | |
| 7,178,462 | B2 | | 2/2007 | Beasley | |
| 7,484,459 | B2 | | 2/2009 | Fichot et al. | |
| 2002/0056397 | A1 | | 5/2002 | Carr et al. | |
| 2003/0209164 | A1 | * | 11/2003 | Pi | 102/510 |
| 2005/0126422 | A1 | * | 6/2005 | Lamm | 102/518 |
| 2005/0183616 | A1 | * | 8/2005 | Eberhart et al. | 102/510 |
| 2006/0096491 | A1 | | 5/2006 | Fichot et al. | |
| 2011/0056404 | A1 | * | 3/2011 | Masinelli | 102/514 |

* cited by examiner

BULLETS WITH LATERAL DAMAGE STOPPING POWER

FIELD OF THE INVENTION

The present invention relates to the field of ammunition for personal defense use and law enforcement use. The present invention particularly relates to ammunition used in handguns having shorter barrel lengths.

BACKGROUND OF THE INVENTION

Ball ammunition uses bullets that are solid or non-expanding and may include musket balls, lead bullets and metal jacketed (such as full metal jacket or "FMJ") bullets. Ball ammunition is typically used by military forces.

Hollow-point ammunition uses bullets that are designed to expand when they hit a target and thereby provide a larger diameter permanent cavity in the target, as well as providing a larger temporary cavity. Hollow-point ammunition is typically used by law enforcement and for personal defense. Hollow point bullets have a hollowed cup at the forward end of the bullet and are designed so that expansion or mushrooming of the bullet's hollowed cup occurs upon or after impact, increasing the effective diameter of the bullet. As the bullet moves through a target at a high rate of speed, material is picked up by the cup and compressed. When the outward pressure created by the material being compression inside the cup exceeds the yield strength of the cup wall(s), the cup mushrooms outwardly, increasing the effective diameter of the bullet. The faster the bullet traverses the medium, the greater is the compression of the captured material. However, the mushrooming of hollow point bullets is dependent on the bullet's terminal velocity; materials such as clothing fabric may become trapped in the cup and block other materials so that mushrooming does not occur. Hollow points seem not to expand reliably or at all in short barreled pistols that are carried for personal defense. Thus, the performance of hollow point bullets is considered to be unreliable in such weapons.

When bullets enter a human target or a ballistic gelatin target there is created a permanent cavity called the crush cavity. There is also created a temporary cavity known as the stretch cavity. The diameter of the crush cavity can be smaller than the caliber of the bullet that made the cavity. Gelatin, like human tissue, will part to admit entry of the bullet and will tend to close behind the bullet after entry and the bullet proceeds along its path. The diameter of the stretch cavity, unlike that of the crush cavity, is usually substantially larger than the diameter of the bullet. This temporary cavity is created by the turbulence of the bullet as it cuts its path through gelatin or tissue. The shape and size of the stretch cavity is defined by the shock and pressure wave associated with a particular bullet shape. Ball and round nosed bullets create the least turbulence. Hollow point bullets, with their cupped front ends, create more turbulence than ball and round nosed bullets whether they expand or not. Typically, injured tissues in the crush cavity are permanently damaged, while tissues in the stretch cavity suffer only temporary damage.

The Federal Bureau of Investigation's "Handgun Wounding Factors and Effectiveness" (1989) discusses the issues facing law enforcement officers who encounter an armed assailant. The article notes that incapacitation of a human target by gunshot wounds is highly unpredictable. Only a shot to the brain or upper spinal cord is considered to have a reliably predictable immediate outcome. Shots in the heart or circulatory system leading to massive bleeding are considered to take time that might allow the assailant an opportunity to injure the officer. Physiological damage from shots placed elsewhere were considered to be unlikely to have any immediate effect. Specifically, the article argues that physiological reaction is typically not the controlling factor in determining incapacitation; rather, it is the psychological reaction of the human target. Awareness of the injury; fear of injury, pain, and death; and loss of desire to continue in an attack all lead to cessation of conflict and to incapacitation of the assailant. However, in many cases, the human target may not even be aware of the wound. Emotional reactions such as rage can block awareness of damage. The effects of adrenaline, stimulants, narcotics, or pain killers may all block awareness of the injury. In such cases, the assailant will continue an attack despite being wounded. There are numerous accounts of shootings in which individuals received lethal gunshot wounds without an immediate cessation of the activity in which they were engaged. It is not unusual for shooting victims to fail to notice they have been shot.

The FBI article concludes that apart from the nervous system shots, the most reliable outcomes requires use of larger diameter bullets that penetrate 12-18 inches into a human target. However, other studies have suggested there may be other factors at play. Evan P. Marshall's and Edwin J. Sanow's 1992 book "Handgun Stopping Power" and follow-up 1996 book "Street Stoppers" (both published by Paladin Press) attempted to document the "stopping power" of various calibers and bullet configurations based on actual recorded shootings. Sanow/Marshall gave Winchester 32 caliber 60 grain Silvertips a 63% OSS ("One Shot Stop") effectiveness rating, which was surprising because they gave the same rating to both .45 caliber 230 grain Federal and .45 caliber 230 grain Winchester full metal jacket ball ammunition. The .32 caliber Silvertips achieved a mere muzzle energy of 125 foot pounds, versus the 356 foot pounds that the .45 Winchester and .45 Federal rounds register. Many of the Sanow/Marshall conclusions have been challenged by authors such as Duncan MacPherson and Martin L. Fackler, M.D., and others, who have contended that bullet weight, size and speed are the only relevant factors in a stopping power analysis.

The argument over the relative stopping power of various bullet shapes, weights, sizes and velocities is likely never to be fully resolved since experiments with living targets is not possible or acceptable. However, experiments with ballistic gelatin and field reports of actual shootings do offer strong clues as to a bullet's stopping power efficacy. The evidence suggests both the crush cavity and stretch cavity play an important role in stopping power. The evidence also strongly suggests that hollow point bullets seem to be most effective when they expand, but that expansion is at best unreliable and inconsistent. That said, even expansion is not a true indicator of a bullet's stopping power potential, since a hollow point bullet's expansion relies on the yield strength of the hollow point cup. A bullet made of cheese would expand enormously but would lack penetration. Cup expansion is as much a measure of the yield strength of the cup as it is of potential stopping power. Expansion has to be coupled with adequate penetration.

SUMMARY OF THE INVENTION

It is a goal of the invention to provide bullets for ammunition adapted for personal defense use and law enforcement use that have an increased likelihood of being noticed by a human target, thus triggering a psychological response in which the target chooses to terminate an assault.

It is a goal of the invention to provide bullets which have a psychological impact larger than their nominal caliber, thus potentially providing an increased stopping effect combined with lower lethality.

It is a goal of the invention to provide a bullet design which provides a more significant damage effect on a target than would be expected by the nominal caliber of the bullet.

It a goal of the invention to provide a bullet design that offers the best combination of penetration and deterrent lateral damage, which increases the effective caliber of the bullet and translates into increased stopping power.

One embodiment of the invention comprises a bullet having a generally cylindrical metal body having a tapered tip section, with a longitudinal cavity preferably aligned with a central longitudinal axis of the tapered tip section and having an open forward end and an inner end enclosed within the body, and one or more radially extending bores connecting with and extending from the inner end of the longitudinal cavity to bore openings. Optionally a frangible jacket is fitted over the body, which desirably has an open end aligned with the longitudinal cavity open end. Another optional feature is a filler or an irritant payload packed in the longitudinal cavity and/or bores.

DETAILED DESCRIPTION OF THE INVENTION

Figure 1:
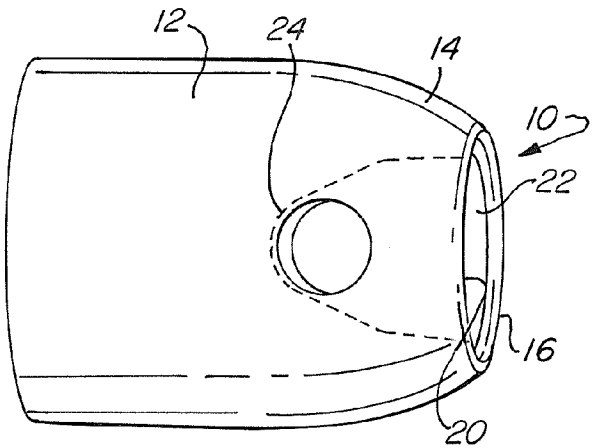
FIG. 1 is a perspective view of an embodiment of a bullet in accordance with the invention.
Figure 3:
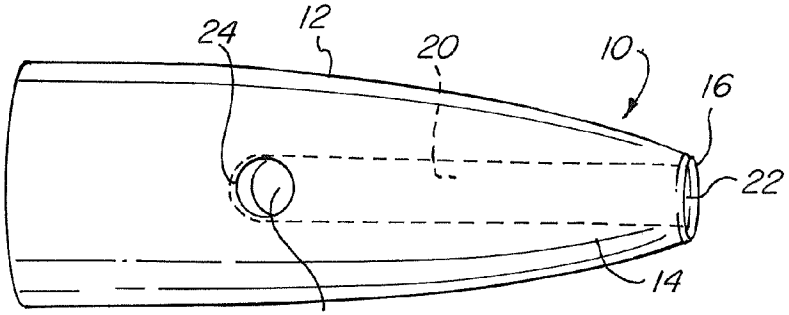
FIG. 3 is a perspective view of another embodiment of a bullet in accordance with the invention.
Figure 2:
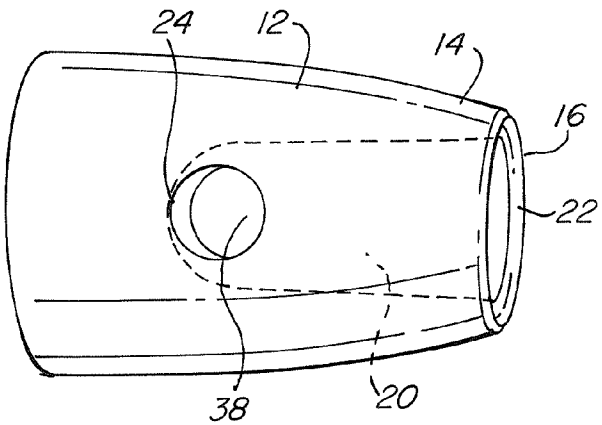
FIG. 2 is a perspective view of another embodiment of a bullet in accordance with the invention.

Referring now to FIGS. 1-14, where like element numbers indicate the same or similar elements among different embodiments, a bullet 10 has a generally cylindrical body 12 having a tapered tip section 14 having a forward end 16. The tapered tip section 14 can be conical, frusto-conical, parabolic, or have other tapered shapes. The present invention is adapted for use in bullets of any shape or caliber, and accordingly three differently shaped exemplary bullets 10, a shorter rounder bullet, a more conical bullet, and a longer pointed bullet are shown in FIGS. 1, 2, and 3. It can be understood from the examples described below that existing tooling for hollow point ammunition and even ball ammunition is readily adaptable to implement the present invention.

Body 12 of bullet 10 has a longitudinal cavity 20 located therein. Cavity 20 is preferably aligned with the central longitudinal axis of the tip section 14. Cavity 20 has an open end 22 at the forward end 16 of bullet 10. Cavity 20 has an inner end 24 enclosed within the body 12. Cavity 20 may take a range of shapes, including circular cross section shapes such as the parabolic and/or conical shapes of FIG. 1, and the cylindrical shape of FIGS. 2 and 3, but also polygonal cross-sectional shapes.

Figure 5:
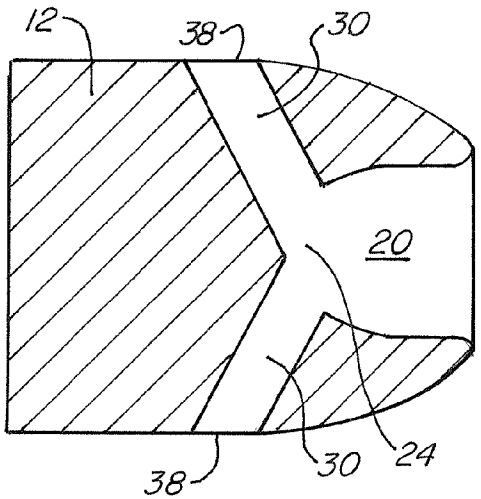
FIG. 5 is a cross-sectional view of another embodiment of a bullet in accordance with the invention.
Figure 6:
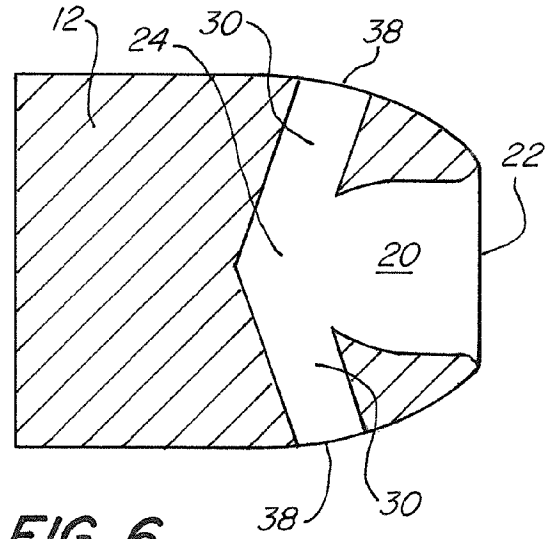
FIG. 6 is a cross-sectional view of another embodiment of a bullet in accordance with the invention.
Figure 7:
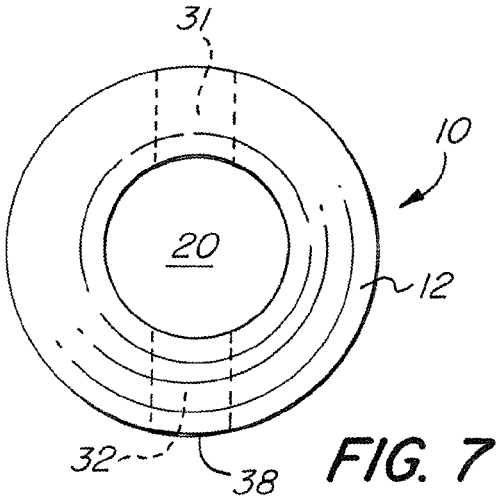
FIG. 7 is a front elevation view of the bullet of FIG. 1.
Figure 8:
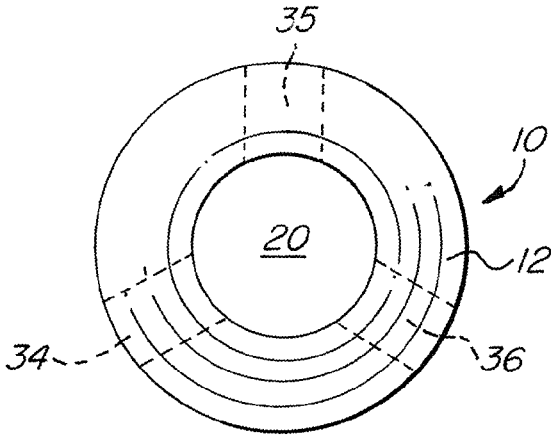
FIG. 8 is a front elevation view of another embodiment of a bullet in accordance with the invention.

One or more bores 30 extend laterally and/or radially outwardly from cavity 20 to bore openings 38. Preferably, the bores 30 are located to connect with and extend laterally from the inner end 24 of the longitudinal cavity 20 as seen in FIGS. 1-6, however, the bores 30 can connect with cavity 20 at other locations, such as the mid-section of cavity 20, if desired. Preferably, there are two bores 31, 32 which extend from opposite sides of the longitudinal cavity at locations 180° apart as seen in FIG. 7 such that the two bores 31, 32 are aligned with each other. However, it is possible to have more than two bores, such as three bores 34, 35, 36 shown in FIG. 8, or four bores (not shown), or five bores.

Another potential embodiment of the invention include the use of multiple cavities, each connected to a single bore and bore outlet. The multiple cavities may be separate cavities or a large cavity divided by thin walls into a plurality of sub-cavities.

Figure 4:
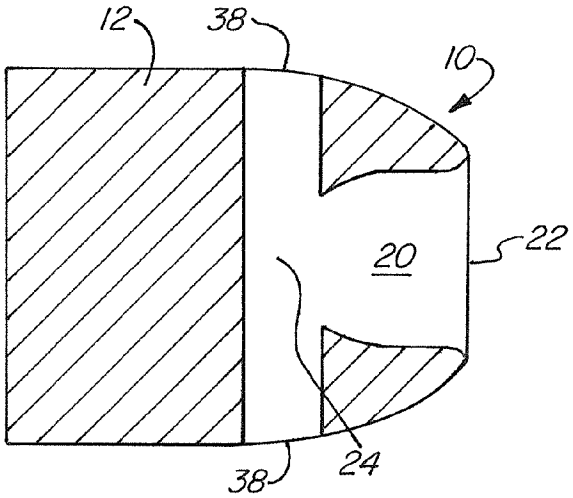
FIG. 4 is a cross-sectional view of the bullet of FIG. 1.

For ease of manufacturing and as a compromise between enhanced damage and penetration, bores 30 extend generally perpendicularly to longitudinal cavity 20 as seen in FIG. 4. However, in other embodiments, bores 30 extend generally forwardly from the longitudinal cavity 20 to the bore openings 38 as seen in FIG. 6, or the bores 30 can extend generally rearwardly from the longitudinal cavity 20 to the bore openings 38 as seen in FIG. 5. The forwardly extending bores 30 would be expected to increase the shock effect on the target relative to a bullet with perpendicular bores. The rearwardly extending bores 30 would be expected to increase penetration of the bullet in the target relative to a bullet with perpendicular bores.

Figure 9:
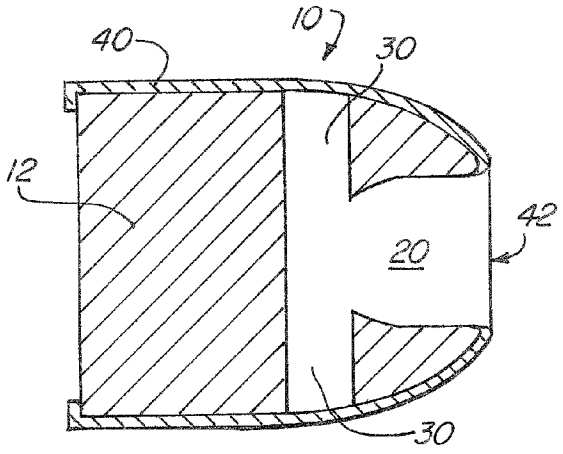
FIG. 9 is a cross-sectional view of a jacketed embodiment of a bullet in accordance with the invention.
Figure 10:
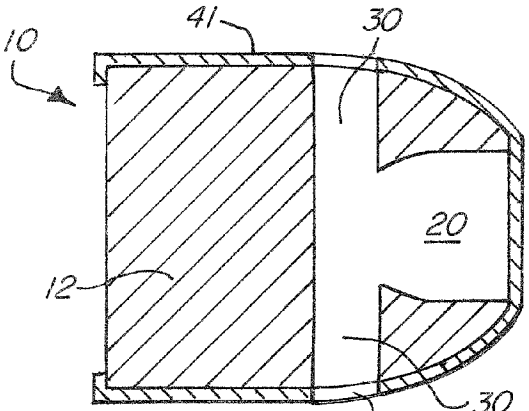
FIG. 10 is a cross-sectional view of another jacketed embodiment of a bullet in accordance with the invention.
Figure 11:
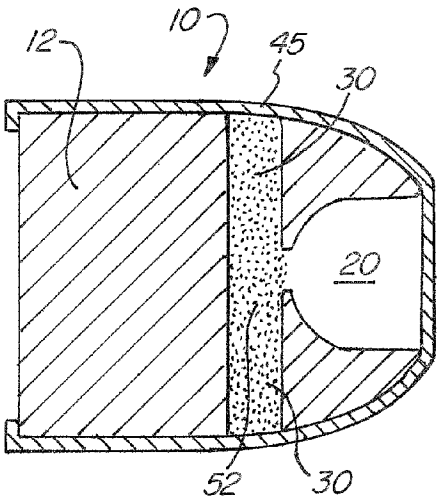
FIG. 11 is a cross-sectional view of another jacketed embodiment of a bullet with an irritant payload in accordance with the invention.
Figure 12:
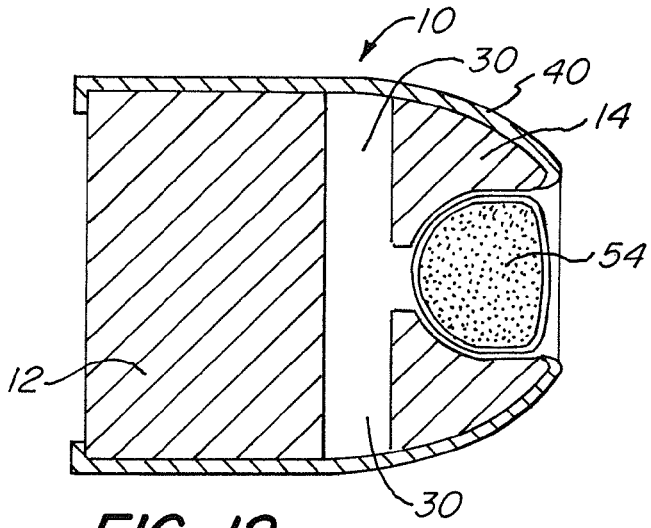
FIG. 12 is a cross-sectional view of another jacketed embodiment of a bullet with an irritant payload in accordance with the invention.

FIGS. 9-12 illustrate different jacketed embodiments of bullet 10. Jacket 40 shown in FIGS. 9, and 12 is a frangible jacket fitted over the body 12. Jacket 40 covers the bore openings 38 but has an open end 42 aligned with the longitudinal cavity open end 22. Jacket 40 desirably is relatively fragile, and while it should be sturdy enough to withstand firing from a firearm, it should deform, rupture or shatter and peel away from the bore openings 38 on impact to allow for effective functioning of the bullet as described below. For example, jacket 40 may be formed from a thin sheet of copper or other easily deformable metal or other material. Jacket 41 shown in FIG. 10 is similarly a frangible jacket, but has openings 43 aligned with the bore opening(s). Jacket 45 shown in FIG. 11 is similarly a frangible jacket, but covers both the bore openings 38 and the cavity. In each case, the jacket 40, 41, and 45 is designed to deform, rupture or shatter and peel away from the cavity open end 22 and bore openings 38 after impact.

The jacketed embodiments of bullet 10 reduce drag and turbulence of the bullet as it travels from a firearm to a target, retaining a greater kinetic force on impact than the unjacketed embodiments of bullet 10, while still providing the effects described below.

In addition, jacketed embodiments of bullet 10 shown in FIGS. 9-12 permit the addition of an irritant payload which can be packed into the bullet. For example, as shown in FIG. 11, an irritant payload 52 can be packed into bores 30, 32. Alternatively, as shown in FIG. 12, an irritant payload 54 can be packed into longitudinal cavity 22, or it may be located in both the longitudinal cavity 22 and bores 30, 32. The irritant payload can be ground pepper, salt, or another particulate, possibly including metal filings, which can spray out through the bore openings 38 to irritate and damage surrounding tissue after impact. For example, in FIG. 12, the irritant payload 54 can be pepper or salt contained in a frangible gel sac. The irritant payload 52, 54 is designed to release into the target and provide additional discomfort and therefore additional encouragement to cease aggressive behavior.

The embodiment shown in FIG. 9, a jacketed bullet with covered bore openings 38 and having an open front end 42, is believed to provide one possible optimum combination of velocity, stability in flight, and damage on impact. This embodiment should have similar travel characteristics to hollow point bullets, but would provide the enhanced damage effect when the bullet enters the target and the thin jacket walls break open.

The following examples describe initial testing of the bullet of the invention.

Example 1

Winchester Silvertip® hollow point bullets in .32ACP caliber were used in comparative testing. Both modified and unmodified rounds were fired into Perma-Gel® ballistic gel using a Seecamp LWS .32 pistol.

The modified bullets were made by drilling two bores, (also called side holes in these examples) of approximately 3/32 of an inch directly opposite each other at the bottom of the hollow point cup in the tip of the bullets. The side holes were plugged with a low melting fusible alloy. The particular alloy used has all the physical properties of lead but will melt in warm water. The cup of the modified bullet was filled with black pepper in contemplation of being able to see damage done to the translucent gel more easily.

Unmodified rounds from the same Winchester lot number and ammunition box were used as a control and comparison.

Upon firing at about a two foot distance, both the modified and unmodified Winchester Silvertip rounds went through 12 inches of gelatin.

The unmodified bullets showed no crush or permanent damage to the gel that equaled or exceeded the diameter of the bullet. Both the entry and exit holes were smooth and extremely small.

The modified bullet, at approximately 11 inches into the gel, opened up one of the plugged side holes, and a side spray of pepper became deeply imbedded in the gel. The exit hole was noticeably more ragged.

Example 2

In a second test, the modified Silvertip round having two side holes of approximately 3/32 of an inch directly opposite each other at the bottom of the hollow point cup in the tip of the bullets was used; neither side hole was plugged and the bullet was not filled with pepper. An unmodified control round from the same lot number was also tested. Both the modified and unmodified rounds were fired into Perma-Gel ballistic gel as before.

The unmodified round passed through twelve inches of gelatin and buried itself in a phone book behind the gel. Some paper tearing was visible at over 200 pages into the book. The recovered bullet showed no deformation of the unmodified bullet. The path of the unmodified bullet appeared as a straight line with little or no gel deformation beyond the path of the bullet.

The modified round passed through twelve inches of gelatin and bounced off the cover of the phone book and left a very slight marking on the first few pages of the book. The recovered bullet showed that the cup of the modified round was filled with gel that had reached the exit point of the bore opening. The modified round caused permanent damage to the gel beyond the narrow path of the bullet. While the ballistic gel exit hole of the unmodified bullet was smooth and impossible to locate by feel, the ballistic gel exit hole of the modified bullet was coarse and surrounded by protruding gel. The reduced penetration of the modified round suggested that more energy was expended within the gel than was expended with the unmodified Silvertip round.

Example 3

Winchester Silvertip® bullets in .32ACP caliber were modified so that two side holes of approximately 3/32 of an inch were situated directly opposite each other at the bottom of the cup. Some modified bullets were additionally modified by filling the cup with pepper and by fitting a thin copper jacket over the cup to retain the pepper. Unmodified rounds from the same Winchester lot number and ammunition box were again used as a control. The pistol used was again a Seecamp LWS .32. The three different rounds were discharged into phone books at a 6 foot range.

The unmodified Winchester Silvertip had the greatest penetration. It left an impression into about 1.9 inches of phone book paper. The cup of the unmodified round just filled up with paper and thereafter apparently performed just like regular ball ammo would. No deformation of the bullet was observed.

The modified Winchester Silvertip with the modified two side hole bullet left an impression on approximately 1.4 inches of phone book paper. This round left a significantly larger diameter hole than the unmodified round. When the phone books were pulled apart, among tiny pieces of shavings there were pieces that measured almost 0.5 inch across, suggesting an apparent significant increase in the effective diameter of the tested bullet.

The modified Winchester Silvertip with the modified two side hole, pepper-filled, jacketed bullet, left an impression on approximately 1.5 inches of phone book paper, and shredded a path through the phone book paper. The pepper stored in the cup was forcefully ejected out of the cup's two side holes after the jacket broke. The pepper ejected with such force that it shredded the paper. A sizable section of the phone book looked like it had been hit by buckshot, with many tiny pieces of loose paper falling out of the phone books when separated.

Example 4

Modified and unmodified Winchester Silvertip® .32 ACP hollow point rounds were fired out of a two inch barrel LWS.32 and were chonographed. The unmodified .32 Silvertip had a velocity at six feet of 751.5 feet per second. The modified .32 Silvertip with side vents had a velocity of 665 feet per second. Other than the substantial velocity drop (86.5 feet per second) the bullet maintained its stability. The velocity loss of the modified round indicates the amount of energy that is diverted to turbulence or side energy.

The tests described in the above examples support the conclusion that the bullets of the present invention provide a damage profile which is greater than would be expected for the nominal caliber of the bullet. Bullet 10 accordingly has an effective caliber that is larger than a nominal caliber of the bullet.

Figure 13:
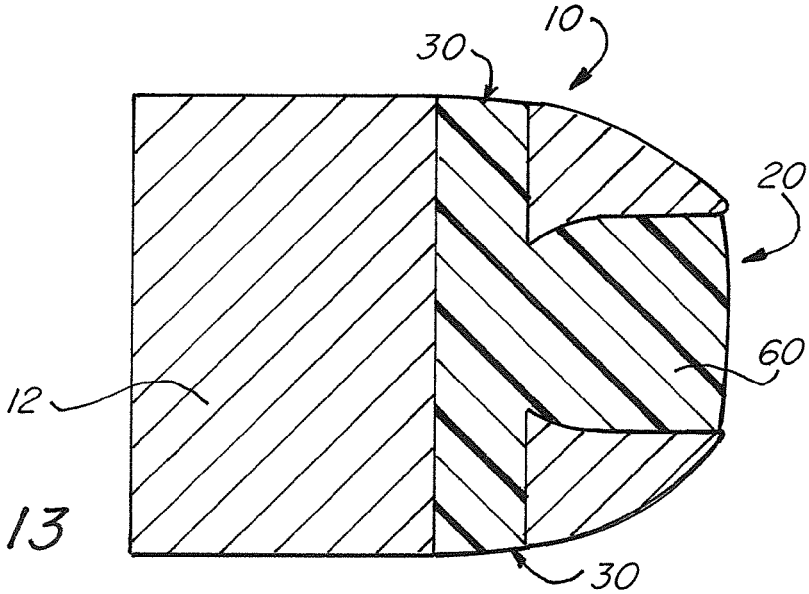
FIG. 13 is a cross-sectional view of a embodiment of a bullet containing a filler in accordance with the invention.

Referring now to FIG. 13, another embodiment of the invention is shown. FIG. 13 shows an unjacketed bullet 10 having a body 12 and a longitudinal cavity 20 and two lateral bores 30. A releasable filler 60 is located in the longitudinal cavity 20 and lateral bores 30. Filler 60 is preferably an elastic or gel material which can be injected into the cavity 20 and bores 30. The material preferably will set up or harden so it will not leak out of the cavity 20 and bores 30 so that the product will be stable and have a long shelf life. However, the filler 60, once hardened, should still be releasable such that on impact the filler 60 is ejected from the bores 30 so that the cavity 20 and bores 30 are cleared. Filler 60 may be a gel, or foam, or elastomer. Exemplary materials that might be used for filler 60 include include polymer gels and ballistic gel, silicone elastomers such as silicone rubber, and urethane elastomers. Even adhesives such as hot melt glue could be used. A release coating such as a light oil may be applied to the longitudinal cavity 20 and two lateral bores 30 to enhance release of the filler 60 on impact.

In some embodiments, the filler 60 material is selected to be capable of increasing frictional interaction with a target, so that energy in the round is transferred to the target as quickly as possible. In other embodiments other considerations will be more important.

In most applications, the filler 60 material should be non-toxic. The purpose of the present invention is to immediately stop the target, not to slowly poison an assailant. Nevertheless, there may be covert operations applications where a toxic filler would be used.

The use of filler 60 provides the same advantages as a jacketed bullet, namely, reduction of drag and turbulence of the bullet as it travels from a firearm to a target, with retention of greater kinetic force on impact than the unfilled, open embodiments of bullet 10. In addition, the releasable filler 60 will increase the size of the entrance hole and/or wound cavity of the target.

Figure 14:
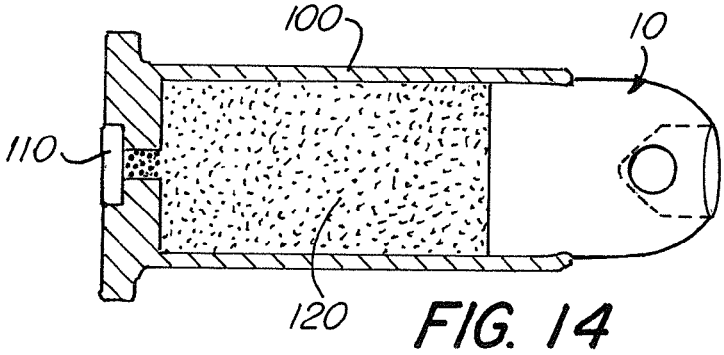
FIG. 14 is a side elevation view of a cartridge for firearm containing the bullet of FIG. 1.

Referring now to FIG. 14, the invention further comprises a cartridge for firearms, comprising a cartridge case 100; a primer 110; a powder charge 120; and bullet 10 as described above.

Figure 15:
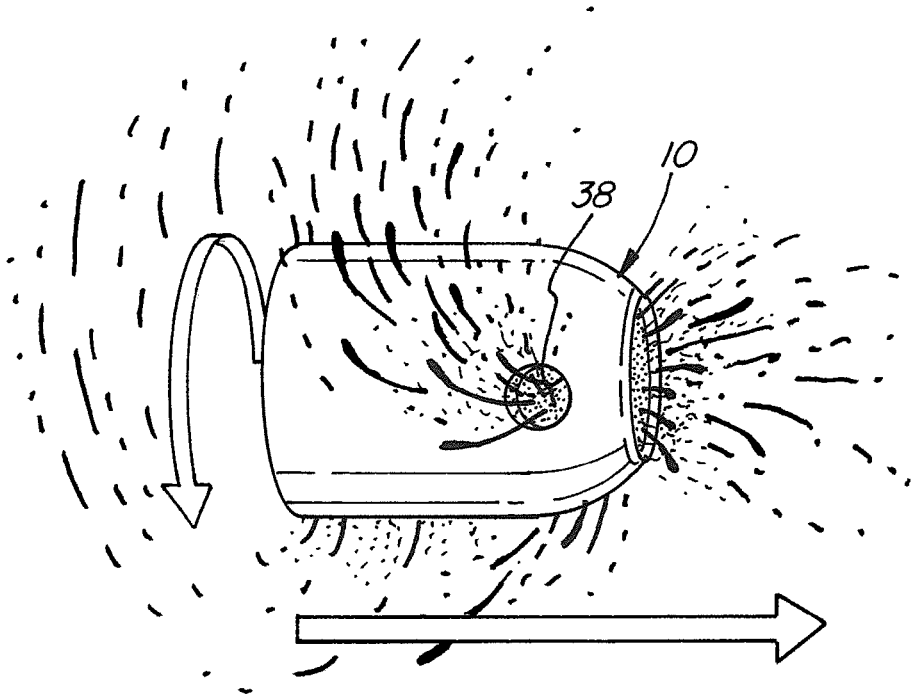
FIG. 15 is an illustration showing the effect of the bullet of FIG. 1 in a target.

FIG. 15 illustrates the expected operation of bullet 10 as it traverses a target object. Without desiring to be bound to any particular mechanism of action or theory of operation, it is believed that the bullets of the present invention demonstrate increased effectiveness due to their ability to provide a turbulent zone of high pressure liquid around the bullet as it traverses a human target. The bullet gathers soft tissue body parts within the cavity 20 as it traverses a target and ejects the liquefied tissue at high velocity out through the radial bore openings 38 causing additional damage in the path of the bullet. It is to be appreciated that the bullet 10 is rotating around its longitudinal axis as it travels and the ejected tissue spirals out from the radial bore openings 38 generating the turbulent zone of high pressure liquid around the path of the bullet 10 which causes significant damage during an initial part of its path through a target. The rotation is likely to end part way through the travel through the target at which time the turbulent zone of high pressure liquid damage and the corresponding crush cavity will change from a circular cross section to a more oval or oblong cross-section since the ejected tissue will extend outwardly from the sides of the bores in the bullet.

The damage in the turbulent zone of high pressure liquid is analogous to the damage that can be inflicted by a high pressure water jet cutter such as is used for cutting metals and other materials. This results in a large diameter crush cavity, so the bullet has an effective caliber that is larger than the nominal caliber of the bullet.

A secondary contributing factor to the effectiveness of the present invention is the possibility of introducing compressed air into the target at the moment of impact. In particular, air pressure will increase in the cavity 20 as the bullet travels and be released through the radial bore openings 38 upon impact. This effect is expected in both the jacketed and unjacketed versions of bullet 10. This additional feature increases the shock experienced by the target on impact.

In the filled embodiment of the invention illustrated in FIG. 13, the properties of filler 60 can be selected to provide a desired damage profile. For example, a relatively weak filler material such as a gel should release from the two lateral bores 30 and potentially also the longitudinal cavity 20 on impact, initiating the formation of the turbulent zone of high pressure liquid around the path of the bullet 10 sooner than it might otherwise, generating shock in the target immediately upon impact. A relatively more durable filler material such as silicone rubber will release a little more slowly, generating shock in the target more deeply in the tissues of the target.

It is expected that the bullets 10 of the present invention will penetrate less deeply into a target than ball ammunition, due to the use of energy to create the turbulent zone. If desired, it should be possible to select cavity and radial bore parameters that provide a bullet that is calibrated to provide an optimum combination effective or apparent caliber, and penetration depth. In particular, the shape, diameter and depth of cavity 20, and the intersection location, diameter and angle of the bores 30, can all be varied to optimize the bullet for a preferred design result. For example, if desired, a bullet that has a large apparent caliber and a lowered risk of permanent damage to deeply located vital organs than ball ammunition or conventional hollow point ammunition may be designed. Such a bullet would also have the benefit of being unlikely to pass through the target and hit a bystander.

The present invention therefore provides a bullet construction that is particularly useful in self defense applications such as smaller handguns frequently used for concealed carry. However, the enhanced damage provided by the bullet of the present invention also is useful in service loads carried by police and other law enforcement officers.

What is claimed is:

1. A bullet, comprising:

a generally cylindrical body having a tapered tip section having a forward end, a longitudinal cavity aligned with a central longitudinal axis of the tapered tip section and having an open end at the tip section forward end, the longitudinal cavity having a cross-sectional area adjacent the open end, the cavity open end having an area, the cavity open end area being substantially equal to the cavity cross-sectional area open end, and an inner end enclosed within the body, two bores connecting with and extending laterally from the inner end of the longitudinal cavity to bore openings; and a releasable polymer filler packed into the longitudinal cavity and the two bores, said polymer filler being solidified within the cavity and bores and being releasable on impact to eject from the bores into a soft tissue target without mushrooming of the tip section forward end.

2. The bullet of claim 1, further comprising a frangible jacket fitted over the body, the jacket having an open end aligned with the longitudinal cavity open end.

3. The bullet of claim 1, further comprising a frangible jacket fitted over the body.

4. The bullet of claim 1, wherein the two bores extend from opposite sides of the longitudinal cavity.

5. The bullet of claim 1, wherein the two bores extend generally perpendicularly to the longitudinal cavity.

6. The bullet of claim 1, wherein the bullet has an effective caliber that is larger than a nominal caliber of the bullet.

7. A cartridge for firearms, comprising:

a cartridge case;

a primer;

a powder charge;

a generally cylindrical body having a tapered tip section having a forward end, a longitudinal cavity having a substantially open end at the forward end of the tip section and an inner end enclosed within the body, one or more bores connecting with and extending laterally from the longitudinal cavity to bore opening(s); and a releasable polymer filler packed in the longitudinal cavity or bores, or both said polymer filler being solidified within the cavity or bores and being releasable on impact to eject from the bores into a soft tissue target, without mushrooming of the tip section forward end.

8. The cartridge of claim 7, further comprising a frangible jacket fitted over the body.

9. The cartridge of claim 8, wherein the frangible jacket has an open end aligned with the longitudinal cavity open end.

10. The cartridge of claim 8, wherein the frangible jacket has opening(s) aligned with the bore opening(s).

11. A bullet, comprising:

a generally cylindrical body having a tapered tip section having a forward end, a longitudinal cavity having an open end at the forward end of the tip section and an inner end enclosed within the body, the longitudinal cavity and the longitudinal cavity open end having similarly sized cross-sectional areas, one or more bores connecting with and extending from the longitudinal cavity to bore opening(s); and a releasable polymer filler packed in one or more of: the longitudinal cavity and the one or more bores, said polymer filler being solidified within the cavity or bores and being releasable on impact to eject from the bores into a soft tissue target without mushrooming of the tip section forward end.

12. The bullet of claim 11, wherein the one or more bores connect with and extend from the inner end of the longitudinal cavity to the bore opening(s).

13. The bullet of claim 12, where there are two or more of the bores.

14. The bullet of claim 13, wherein there are two of the bores extending from the longitudinal cavity from opposite sides of the longitudinal cavity at locations 180 degrees apart.

15. The bullet of claim 11, wherein there are two of the bores extending from the longitudinal cavity and the two bores are aligned with each other.

16. The bullet of claim 11, wherein the one or more bores extend generally perpendicularly to the longitudinal cavity.

17. The bullet of claim 11, wherein the longitudinal cavity is aligned with a central longitudinal axis of the tapered forward tip section.

18. The bullet of claim 11, further comprising a frangible jacket fitted over the body.

19. The bullet of claim 18, wherein the frangible jacket has an open end aligned with the longitudinal cavity open end.

20. The bullet of claim 18, wherein the frangible jacket has opening(s) aligned with the bore opening(s).

21. The bullet of claim 11, wherein the bullet has an effective caliber that is larger than a nominal caliber of the bullet.

22. A bullet having a longitudinal cavity having a substantially open end at a forward end of the bullet and one or more laterally extending bores connecting with and extending from longitudinal cavity to bore openings, and a releasable polymer filler packed in the longitudinal cavity or bores, or both, said polymer filler being solidified within the cavity or bores and being releasable on impact to eject from the bores into a soft tissue target, without mushrooming of the tip section forward end, and having an effective caliber that is larger than a nominal caliber of the bullet.

23. The cartridge of claim 7, wherein the releasable polymer filler is packed into the longitudinal cavity and the one or more bores.

24. The bullet of claim 11, wherein the releasable polymer filler is packed into the longitudinal cavity and the one or more bores.

* * * * *